US010955216B2

(12) United States Patent
Pedicini

(10) Patent No.: US 10,955,216 B2
(45) Date of Patent: Mar. 23, 2021

(54) PROJECTILE LAUNCHING APPARATUS WITH MAGNETIC BOLT VALVE

(71) Applicant: Tricord Solutions, Inc., Franklin, TN (US)

(72) Inventor: Christoper Pedicini, Franklin, TN (US)

(73) Assignee: Tricord Solutions, Inc., Franklin, TN (US)

( * ) Notice: Subject to any disclaimer, the term of this patent is extended or adjusted under 35 U.S.C. 154(b) by 0 days.

(21) Appl. No.: 16/233,329

(22) Filed: Dec. 27, 2018

(65) Prior Publication Data

US 2020/0132412 A1 Apr. 30, 2020

Related U.S. Application Data

(60) Provisional application No. 62/753,003, filed on Oct. 30, 2018.

(51) Int. Cl.
*F41B 11/723* (2013.01)
*F41B 11/64* (2013.01)

(52) U.S. Cl.
CPC ..... *F41B 11/723* (2013.01); *F41B 11/64* (2013.01)

(58) Field of Classification Search
CPC ..... F41A 19/60; F41B 11/64; F41B 11/71; F41B 11/72; F41B 11/723
See application file for complete search history.

(56) References Cited

U.S. PATENT DOCUMENTS 1,343,127 A * 6/1920 Hallinan ..... F41B 6/00 124/54
2,568,432 A * 9/1951 Cook ..... F41B 11/55 124/65
2,604,088 A * 7/1952 Wells ..... F41B 11/68 124/67
3,212,490 A * 10/1965 Merz ..... F41B 11/642 124/67
3,951,038 A * 4/1976 Van Langenhoven .... B25C 1/12 89/7
4,899,717 A * 2/1990 Rutten ..... F41A 7/06 124/67
4,936,282 A * 6/1990 Dobbins ..... F41B 11/52 124/73
5,261,384 A * 11/1993 Hu ..... F41B 11/57 124/66
5,381,928 A * 1/1995 Lee ..... F41B 9/0031 124/65

(Continued)

*Primary Examiner* — Derrick R Morgan
(74) *Attorney, Agent, or Firm* — Aidenbaum Schloff and Bloom PLLC

(57) ABSTRACT

A projectile launching apparatus includes a bolt (for chambering a projectile) and a bolt valve with a gas passageway for communicating the gas from a chamber housing to a breech assembly. Gas received within the gas chamber is compressed by a piston and communicated through the breech assembly to a projectile. The compressed gas expands in the barrel, thereby propelling the projectile out of the barrel in a single stroke of the piston. The bolt may be returned to an initial position by a magnet and/or spring that is coupled to the valve, and the piston may be returned to an initial position by way of vacuum pressure. The bolt valve may also include a mechanical retention element such as a sear and a release pin. The sear may the bolt in a first position until the piston from the compressor has moved sufficiently to push the release pin.

19 Claims, 7 Drawing Sheets

(56) References Cited

U.S. PATENT DOCUMENTS 5,383,442 A * 1/1995 Tippmann ..... F41A 29/02 124/73
5,727,538 A * 3/1998 Ellis ..... F41B 11/52 124/77
5,778,868 A * 7/1998 Shepherd ..... F41B 11/723 124/73
5,878,736 A * 3/1999 Lotuaco, III ..... F41B 11/52 124/71
6,302,092 B1 * 10/2001 Juan ..... F41B 11/57 124/31
6,564,788 B1 * 5/2003 Hu ..... F41B 7/003 124/66
6,694,963 B1 * 2/2004 Taylor ..... F41A 19/59 124/32
7,665,396 B1 * 2/2010 Tippmann, Jr. ..... B25C 1/08 89/7
7,694,448 B2 * 4/2010 Iwasawa ..... F41B 11/644 42/54
7,730,881 B1 * 6/2010 Pedicini ..... F04B 35/04 124/65
7,946,283 B2 * 5/2011 Lee ..... H03G 3/30 124/67
7,975,682 B2 * 7/2011 Yang ..... F41B 11/642 124/67
7,984,708 B2 * 7/2011 Pedicni ..... F41B 11/64 124/65
8,146,193 B1 * 4/2012 Franzino ..... B08B 9/055 15/3.5
8,146,577 B2 * 4/2012 Hu ..... F41B 11/646 124/32
8,297,269 B2 * 10/2012 Hu ..... F41B 11/646 124/67
8,733,610 B2 * 5/2014 Pedicini ..... B25C 5/15 227/130
8,800,541 B2 * 8/2014 Hu ..... F41A 33/06 124/66
8,800,834 B2 * 8/2014 Pedicini ..... B25C 1/04 227/2
9,121,660 B2 * 9/2015 Yang ..... F41B 11/646
9,636,812 B2 * 5/2017 Pedicini ..... B25C 1/047
9,638,490 B1 * 5/2017 Shen ..... F41B 11/721
9,952,015 B2 * 4/2018 Kang ..... F41B 11/55
10,024,625 B2 * 7/2018 Cheng ..... F41B 11/646
10,393,472 B1 * 8/2019 Wei ..... F41B 11/723
2003/0005918 A1 * 1/2003 Jones ..... F41B 11/721 124/70
2003/0047175 A1 * 3/2003 Farrell ..... F41B 11/52 124/76
2004/0089280 A1 * 5/2004 Kunimoto ..... F41B 11/723 124/76
2004/0144377 A1 * 7/2004 Dobbins ..... F41B 11/52 124/74
2005/0000505 A1 * 1/2005 Pedicini ..... F04B 9/02 124/63
2005/0235975 A1 * 10/2005 Pedicini ..... F41B 11/64 124/67
2006/0162787 A1 * 7/2006 Yeh ..... F41B 11/72 137/596.17
2007/0209650 A1 * 9/2007 Jones ..... F41B 11/73 124/73
2007/0289586 A1 * 12/2007 Tsurumoto ..... F41B 11/55 124/73
2008/0078369 A1 * 4/2008 Yeung ..... F41B 11/681 124/67
2008/0155875 A1 * 7/2008 Iwasawa ..... F41B 11/89 42/54
2008/0173291 A1 * 7/2008 Halmone ..... F41B 11/73 124/77
2009/0056693 A1 * 3/2009 Pedicini ..... F41B 11/64 124/73
2009/0101129 A1 * 4/2009 Wood ..... F41B 11/724 124/77
2009/0235911 A1 * 9/2009 Klarborg ..... F41B 11/646 124/66
2010/0065032 A1 * 3/2010 Yang ..... F41B 11/57 124/27
2010/0236802 A1 * 9/2010 Berger ..... B25D 11/064 173/118
2011/0146647 A1 * 6/2011 Hu ..... F41B 11/723 124/76
2012/0192847 A1 * 8/2012 Hague ..... F41B 11/721 124/77
2013/0118050 A1 * 5/2013 Alicea ..... F41A 19/58 42/84
2014/0338649 A1 * 11/2014 Williams ..... F41B 11/55 124/73
2015/0053194 A1 * 2/2015 Li ..... F41B 11/683 124/69
2015/0176942 A1 * 6/2015 Hu ..... F41B 11/71 124/32
2016/0047620 A1 * 2/2016 Tseng ..... F41A 19/33 124/65
2016/0061549 A1 * 3/2016 Patterson ..... F41G 1/00 42/69.01
2016/0116248 A1 * 4/2016 Cheng ..... F41B 11/71 124/16
2018/0112948 A1 * 4/2018 Iwasawa ..... F41B 11/642
2018/0172392 A1 * 6/2018 Malheiros ..... F41B 11/68
2019/0072359 A1 * 3/2019 Tseng ..... F41B 11/71
2019/0316872 A1 * 10/2019 Luke ..... F41A 1/06
2019/0346226 A1 * 11/2019 Shneorson ..... F41A 19/59
2020/0132412 A1 * 4/2020 Pedicini ..... F41B 11/64
2020/0141672 A1 * 5/2020 Silva ..... F41B 11/71

* cited by examiner

PROJECTILE LAUNCHING APPARATUS WITH MAGNETIC BOLT VALVE

CROSS-REFERENCE TO RELATED APPLICATIONS

The present application claims priority under 35 U.S.C. § 119 upon U.S. Provisional Patent Application Ser. No. 62/753,003, filed on Oct. 30, 2018, the disclosure of which is incorporated by reference.

FIELD

The present disclosure relates to projectile launching mechanisms and more specifically, to projectile launching apparatuses using battery power for portable operation.

BACKGROUND OF THE DISCLOSURE

This disclosure relates to an improvement to electric motor driven guns, air rifles, pellet rifles, paintball guns and the like. Such guns have, in the prior art, been typically driven by either an electrically cocked spring or an on demand compressor running from a battery. The valving and breech arrangement common to such prior art devices suffers from a number of disadvantages outlined in more detail below.

Electric motor driven air rifles have been around for many years and have seen numerous evolutionary changes over the years. The most common methods for propelling the projectile use the energy from compressed gas or from a spring. There are two major techniques shown in the prior art for launching the projectile with a number of variations based upon such teachings. These techniques include: (i) the use of a motor to cock a spring, which spring is then released to fire a projectile and (ii) using a single stroke compressor which opens a valve allowing the compressed air to fire the projectile. Specifically, the valve and bolt actuation heretofore disclosed in these methods have distinct disadvantages when compared to the present disclosure.

A first technique uses a motor to wind a spring is shown in U.S. Pat. Nos. 5,261,384 and 6,564,788. Herein, a motor is used to compress a spring which is connected to a piston. The spring is subsequently quickly released, allowing it to drive a piston compressing air which pushes a projectile out the barrel. This implementation suffers from limitations inherent in the spring piston systems. Hu teaches of using a motor to wind a spring in these patents. Because there is no compression valve, the spring must quickly compress the air against the projectile to force it out the barrel at good velocity. This requires a strong spring to rapidly compress the air when the mechanism releases. Springs in such systems are highly stressed mechanical elements that are prone to breakage and which increase the weight of the air gun. A further disadvantage of Hu's teaching is that the spring is cocked via a rack and pinion mechanism and the spring is released from the rack pinion under full load, causing the tips of the gear teeth to undergo severe tip loading. This causes high stress and wear on the mechanism, especially the gear teeth. This is the major complaint for those guns in the commercial market and is a major reliability issue with this style mechanism.

A further disadvantage of this type of mechanism is that upon scaling up (to accept larger projectiles or projectiles with more energy), there occurs a significant increase in the wear and forward recoil both of which lead to unacceptable reliability and performance. Forward recoil is the result of the piston impacting the front end of the cylinder. In a dry fire (no projectile), the mechanism can be damaged as the piston slams against the face of the cylinder. Hu teaches use of a breech shutoff, which is common in virtually all toy guns since the air must be directed down the barrel and the flow into the projectile inlet port must be minimized. Hu specifically does not incorporate an air compression valve in his patents which is a restrictive valve against which the piston compresses the air for subsequent release. Thus, forward recoil, high wear and low power are drawbacks in these types of mechanisms.

A similar reference can be seen in U.S. Pat. No. 1,447,458 which shows a spring winding and then delivery to a piston to compress air and propel a projectile. In this case, the device is for non-portable operation.

An additional technique, described in U.S. Pat. Nos. 6,857,422 and 7,712,462 and 7,730,881 and 7,984,708 overcomes many of the limitations of the prior art by using a novel compressor on demand system. While this system overcomes the double recoil, difficulty in cocking, and the need for compressed air, there still remains the need to efficiently couple the air which is compressed to the projectile. The methods described in the U.S. Pat. Nos. 6,857,422 and 7,712,462 patents distinctly separate the bolt and valve system. Since the breech (i.e., the projectile inlet port) for an airgun must be closed before the air is released, the timing of the bolt movement and the valve actuation must be carefully coordinated to improve efficiency. If the valve is opened before the breech is sealed, the projectile is pushed off of the bolt and air can blow out through the breech, and efficiency is reduced. Additionally, the bolt and breech shown in these patents have long strokes on the bolts which severely limit the open time of the breech for projectile feeding. This requires use of a powered feeder, which adds to the complexity of the unit and, in the case of a passive feeder, generally limits the firing speed to about 4 balls per second. This is a significant restriction and can limit the application to lower firing rate guns or necessitate the use of a feeder. Additionally, as can be seen in the specification, such systems are complex and must be carefully designed to avoid a pinch point when the bolt crossed and closes the breech opening.

Further taught in U.S. Pat. No. 7,794,708 is the use of a cam drive to actuate the bolt mechanism. Although this is an improvement by allowing more time in the open breech condition and thus improving the rate of fire, it substantially increases the complexity of the mechanism and thereby its cost. Furthermore again the cam drive can create a safety issue if the bolt is closed using the cam as a pinch point is created between the breech and the moving bolt.

Shown in U.S. Pat. Nos. 2,568,432 and 2,834,332 is a method to use a solenoid to directly move a piston which compresses air and forces the projectile out of the air rifle. While this solves the obvious problem of manually pumping a chamber up in order to fire a gun and is a simple implementation, these devices are incapable of generating sufficient energy to fire anything but low energy projectiles. Solenoids are inefficient devices and can only convert very limited amounts of energy due to their operation. Furthermore, since the air stream is coupled directly to the projectile in this technique as it is in spring piston designs, the projectile begins to move as the air is being compressed. This limits the ability of the solenoid to store energy in the air stream to a very short time period and further relegates its use to low energy air rifles. In order to improve the design, the piston must actuate in an extremely fast time frame in order to prevent significant projectile movement during the compression stroke. This results in a very energetic piston mass similar to that shown in spring piston designs and further results in the undesirable double recoil effect as the piston mass must come to a halt. Additionally, this technique suffers from dry-fire in that the air is compressed between the piston and the projectile. A missing projectile allows the air to communicate to the atmosphere through the barrel and can damage the mechanism in a dry-fire scenario.

Another variant of this approach is disclosed in U.S. Pat. No. 1,375,653, which uses an internal combustion engine instead of a solenoid to act against the piston. Although this solves the issue of sufficient power, it is no longer considered an air rifle as it becomes a combustion driven gun. Moreover, it suffers from the aforementioned disadvantages including complexity and difficulty in controlling the firing sequence.

Further shown in U.S. Pat. Nos. 4,137,893 and 2,398,813 to Swisher are the use of an air compressor coupled to a storage tank which is then coupled to the air gun. Although this solves the issue of double recoil, it is not suitable to a portable system due to inefficiencies of compressing air and the large tank volume required. This type of system is quite similar to existing paintball guns in that the air is supplied via a tank rather than as compressed on demand. Using air in this fashion is inefficient and not suitable for portable operation since much of the air compression energy is lost to the environment through the air tank via cooling. Forty percent or more (depending on the compression ratio) of the compressed air energy is stored as heat and is lost to do work when the air is allowed to cool. Furthermore, additional complexity and expense is required to regulate the air pressure from the tank so that the projectile velocity is repeat ably controlled.

A variation of the above is to use a direct air compressor as shown in U.S. Pat. No. 1,743,576. Again, due to the large volume of air between the compression means and the projectile, much of the heat of compression is lost leading to inefficient operation. Additionally, this patent teaches of a continuously operating device, which suffers from a significant lock time (time between trigger pull and projectile leaving the barrel) as well as the inability to run in a semiautomatic or single shot mode. Further disadvantages of this device include the pulsating characteristics of the air stream which are caused by the release and reseating of the check valve during normal operation.

An additional technique is to use direct mechanical action on the projectile itself. The teachings in U.S. Pat. Nos. 1,343,127 and 2,550,887 represent such mechanisms. Limitations of this approach include difficulty in achieving high projectile velocity since the transfer of energy must be done extremely rapidly between the impacting hammer and the projectile. Further limitations include the need to absorb a significant impact as the solenoid plunger must stop and return for the next projectile. This causes a double-recoil or forward recoil. Since the solenoid plunger represents a significant fraction of the moving mass (i.e. it often exceeds the projectile weight), this type of system is very inefficient and limited to low velocity, low energy air guns as may be found in toys and the like. Variations of this method include those disclosed in U.S. Pat. No. 4,694,815 in which a hammer driven by a spring contacts the projectile. The spring is "cocked" via an electric motor, but again, this does not overcome the prior mentioned limitations.

All of the currently available devices suffer from one or more of the following disadvantages: Manual operation by cocking a spring or pumping up an air chamber. Difficult to selectively perform single fire, semiautomatic, burst or automatic modes. Inconvenience, safety and consistency issues associated with refilling, transport and use of high-pressure gas or carbon dioxide cylinders. Non-portability and low efficiency which are associated with compressed air supplied from a typical air compressor. Forward recoil effects, high wear, and dry fire damage associated with spring piston and electrically actuated spring piston designs. Complicated mechanisms associated with electrically winding and releasing a spring piston design resulting in expensive mechanisms with reliability issues. Inefficient use and/or coupling of the compressed air to the projectile resulting in low energy projectiles and large energy input requirements. Safety issues associated with pinch points and limited cyclic rates due to slow bolt speeds.

SUMMARY OF THE DISCLOSURE

In view of the foregoing disadvantages inherent in the prior art, the general purpose of the present disclosure is to provide a suitable bolt and valve mechanism which is particularly suited for an electric motor driven projectile launching apparatus that includes all the advantages of the prior art, and to overcome the drawbacks inherent therein.

In an embodiment the present disclosure provides a projectile launching apparatus with a magnetic bolt valve incorporating a compression on demand system powered by an electric motor and slider crank arrangement.

In an embodiment, a motor is electrically connected to a power source; a gas chamber housing (such as a cylinder and referred to from time to time in the specification as a cylinder for convenience, but it will be apparent that the configuration of the gas chamber housing is not limited to a cylindrical configuration); a piston a slider crank arrangement are driven by the motor and coupled to the piston; a breech assembly, a bolt, a barrel; and a valve arrangement coupled to the bolt and operationally disposed between the cylinder and the barrel.

In an embodiment a magnet or electromagnet is used to maintain the bolt in an initial position while force on the bolt increases.

In an embodiment a spring is used to reset the position of the bolt to an initial position.

In an embodiment, the breech assembly preferably comprises a barrel, a projectile inlet port and a bolt operationally coupled to a valve and disposed within the breech, a bolt retention means and a reset spring. The bolt is capable of moving within the breech. In a further embodiment the bolt movement chambers a projectile and closes off the projectile inlet port.

In an embodiment the valve arrangement includes a gas passageway for communicating the gas from a gas chamber to the breech assembly. When the force retaining the bolt is exceeded, the bolt moves and chambers a projectile.

In an embodiment, the bolt seals off the projectile inlet chamber prior to the valve opening and communicating the gas in the gas chamber to the breech.

In one aspect of the present disclosure the bolt valve comprises a valve body; a retention element (such as a magnet, for example), a bolt, a valve (which may include a stem) coupled to the bolt and, a tube; wherein the gas in the gas chamber is isolated from the projectile by the valve. In this arrangement, the gas in the gas chamber (also referred to herein as an air chamber) is communicated to the projectile through the valve when the force overcomes the retentive force on the bolt. The force which is required to overcome the retentive force of the retention or detent element is referred to as the breakaway force. The breakaway force may be overcome by gas pressure force, mechanical force, and/or electrical force (such as a solenoid or electromagnet for the latter embodiment), for example. The bolt releases from the magnet and moves forward chambering the projectile while shutting off the breech inlet. At or near the point at which the ball (or other projectile) is chambered, the valve opens, allowing flow of the air through the bolt and to the projectile, thus pushing the projectile out of the barrel.

In another embodiment, the bolt may have a protrusion that may be impacted by a mechanical element. This impact may also generate the requisite breakaway force to release the bolt from the detent. Once the projectile has fired, the force from a spring can reset the bolt to its first position, thereby resealing the compression chamber and opening the breech for feeding the next projectile.

In another embodiment, the disclosure comprises a bolt valve apparatus for an electrically driven projectile launching apparatus. In an embodiment, the bolt valve apparatus comprises a breech assembly; an opening in the breech; a bolt reciprocally movable within the breech; an opening for a projectile in the breech; a barrel connected to said breech; a valve coupled to the bolt; a retention element the retention element capable of retaining said bolt in a first position until a break-away force of the retention element is exceeded; and a gas passageway disposed through the bolt for pneumatically connecting the compressed gas to the projectile. In an embodiment, when the force on the bolt exceeds the breakaway force of the retention element, said bolt moves from said first position to a second position. and at the second position the projectile is chambered into a firing position. In an embodiment, at or near the second position, the valve is opened to communicate compressed gas through the bolt to said projectile. In an embodiment, thereafter, the bolt returns to its first position and the retention element thereafter retains said bolt in the first position until a repeat cycle is initiated.

In another aspect of the present disclosure, the bolt valve consists of a mechanical retention element such as a sear and a release pin. The sear retains the bolt in a first position until a mechanical element (such as a piston) has moved sufficiently to push the release pin. The release pin releases the sear allowing the bolt to move forward under the pressure of the air from the gas chamber. The bolt continues to move forward chambering the projectile while shutting off the breech inlet. At or near the point at which the ball (projectile) is chambered, the valve opens, allowing free flow of the air through the bolt and to the projectile pushing it out of the barrel.

These together with other aspects of the present disclosure, along with the various features of novelty that characterize the disclosure, are pointed out with particularity in the claims annexed hereto and form a part of this disclosure. For a better understanding of the disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWING FIGURES

The advantages and features of the present disclosure will become better understood with reference to the following detailed description and claims taken in conjunction with the accompanying drawings, wherein like elements are identified with like symbols, and in which FIG. 1 is a longitudinal cross-sectional view of the projectile launching apparatus 100, incorporating a slider crank arrangement 23 illustrating a piston 5 of a gas chamber housing 14 moving from a first position towards a second position, according to an exemplary embodiment of the present disclosure;

FIG. 2 is a longitudinal cross-sectional view of the projectile launching apparatus 100, illustrating the piston 5 reaching the second position and allowing air to refill the air chamber 21, according to an exemplary embodiment of the present disclosure;

FIG. 3 is a longitudinal cross-sectional view of the projectile launching apparatus 100, illustrating the piston 5 moving back to its first position compressing air in air chamber 21 and the bolt 16 moving to a closed position to chamber the projectile from the breech into the barrel, according to an exemplary embodiment of the present disclosure;

Like reference numerals refer to like parts throughout the description of several views of the drawings.

DETAILED DESCRIPTION OF THE DISCLOSURE

Figure 1:
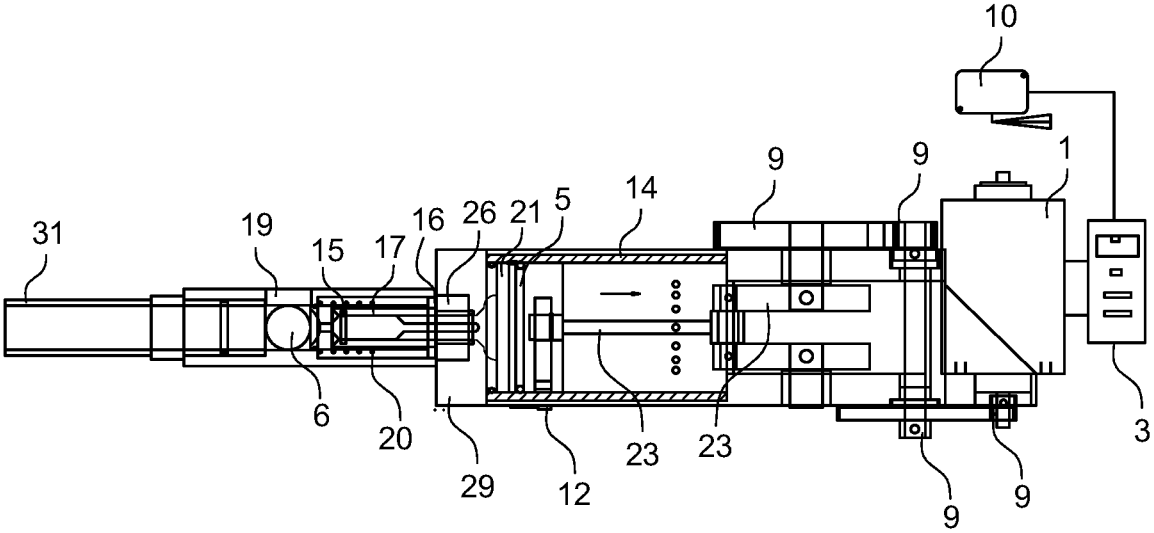
Figure 2:
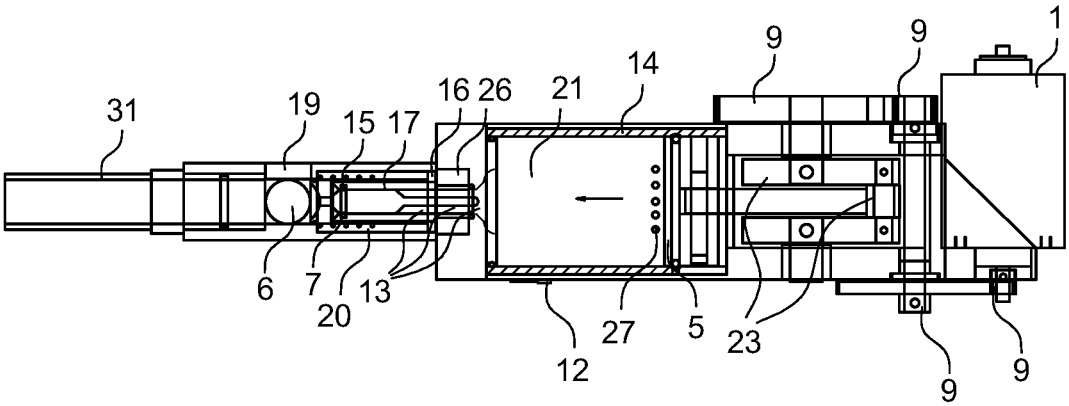

The exemplary embodiments described here in detail are for illustrative purposes and are subject to many variations in structure and design. It should be emphasized, however, that the present disclosure is not limited to a particular projectile launching apparatus, as shown and described. It is understood that various omissions and substitutions of equivalents are contemplated as circumstances may suggest or render expedient, but these are intended to cover the application or implementation without departing from the spirit or scope of the claims of the present disclosure. For example, the term intake valve refers to a means of replenishing the air chamber. It can be a check valve, electric valve or even holes in the side of the gas chamber housing the main purpose being to re-establish approximately atmospheric air pressure in the air chamber at one end of the stroke.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. Furthermore, references to gas chamber or air chamber or top dead center ("TDC") and bottom dead center ("BDC") refer to approximate positions and not meant to limit to exactly that one specific position.

In an embodiment, the front end of the compression piston (5), the gas chamber housing (14) and the gas chamber housing end cap (29) (which in an embodiment captures the magnet for the bolt valve) define the volume of the gas chamber (also referred to as air chamber) (21). At its maximum volume state the gas chamber (21) has a volume that is proportional to the projectile to be fired. For example, for a 3 gram paintball to be launched at 300 fps, a volume in the approximate range of 9 $in^3$-11 $in^3$ at standard temperature and pressure conditions, and more preferably 10 $in^3$, may be used.

Figure 3:
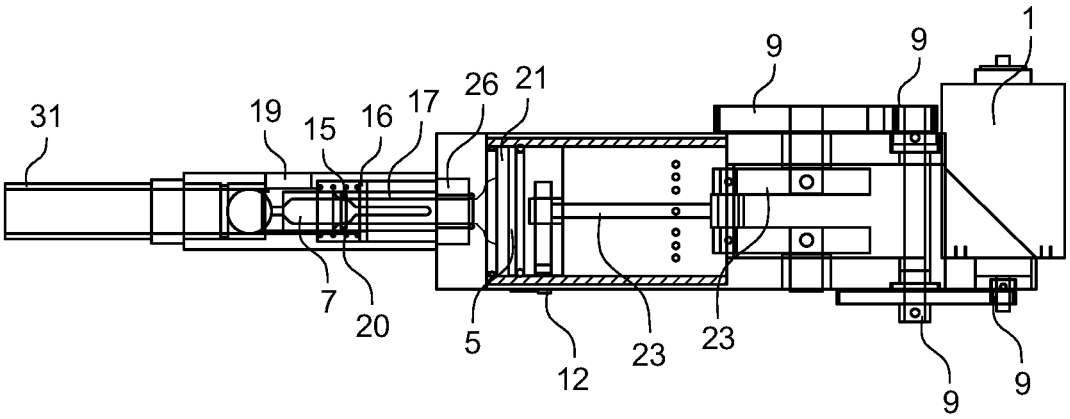
Figure 4:
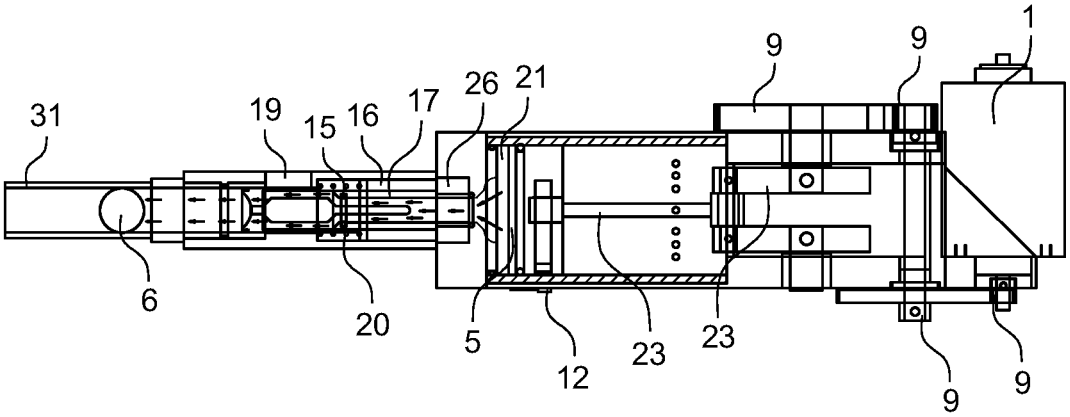
FIG. 4 is longitudinal cross-sectional view of the projectile launching apparatus 100, illustrating opening of the valve and air flowing through the valve to push the projectile out of the barrel according to an exemplary embodiment of the present disclosure.
Figure 5:
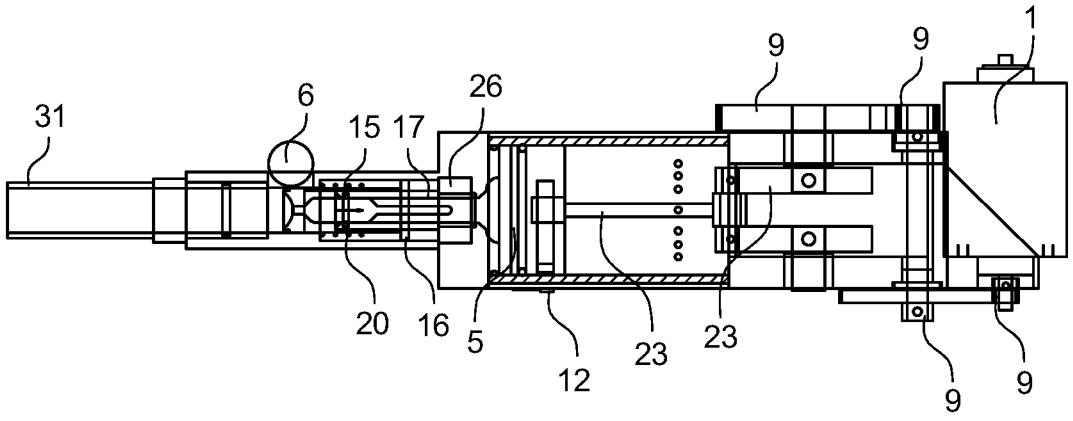
FIG. 5 is a view of the projectile apparatus with the piston returning to a first position and the bolt returning to its first position according to an exemplary embodiment of the present disclosure.

Referring to FIG. 1, the cycle is initiated by the user pressing a start switch (10) or trigger that causes power to be directed from the power source (not shown) to the motor (1) through the control circuit (3). The control circuit (3) may be any apparatus for connecting power to the motor (1) for the purpose of initiating a cycle and then removing the power to the motor (1) after the cycle has substantially completed. The slider crank (23) and compression piston (5) assembly (also referred to as a linear air compressor) is returned to substantially the same start position at the end of the cycle. Directing power to the motor (1) causes it to turn, transferring energy through the rotating elements of the system and into the slider crank as shown in FIG. 3. The motor (1) continues to rotate transferring energy through the drive train (9) which is preferably a series of gears forming a reduction apparatus. This in turn rotates the slider crank thereby moving the compression piston (5) away from the bolt valve and draws a vacuum in the gas chamber (21). At this point, the compression piston may pass an intake valve, such as a series of holes (27), or an enlarged section in the compression chamber to allow air to bleed into and replenish the air in the gas chamber (21). Alternatively, a mechanically activated intake valve may be provided and used to replenish the air in the gas chamber housing.

Figure 11:
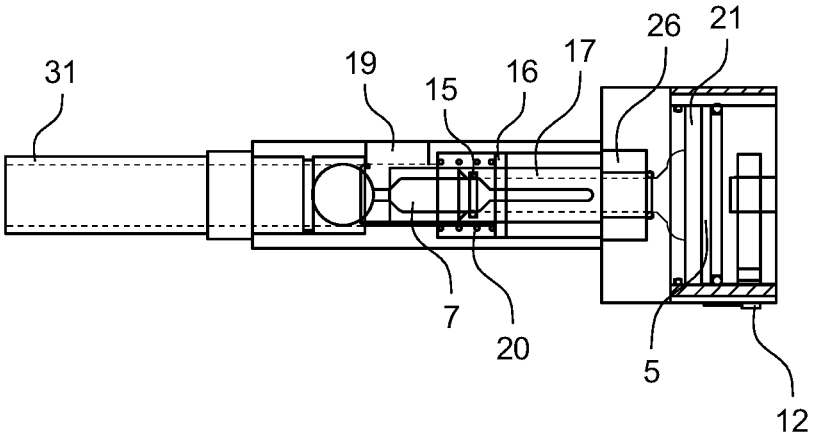
Figure 12:
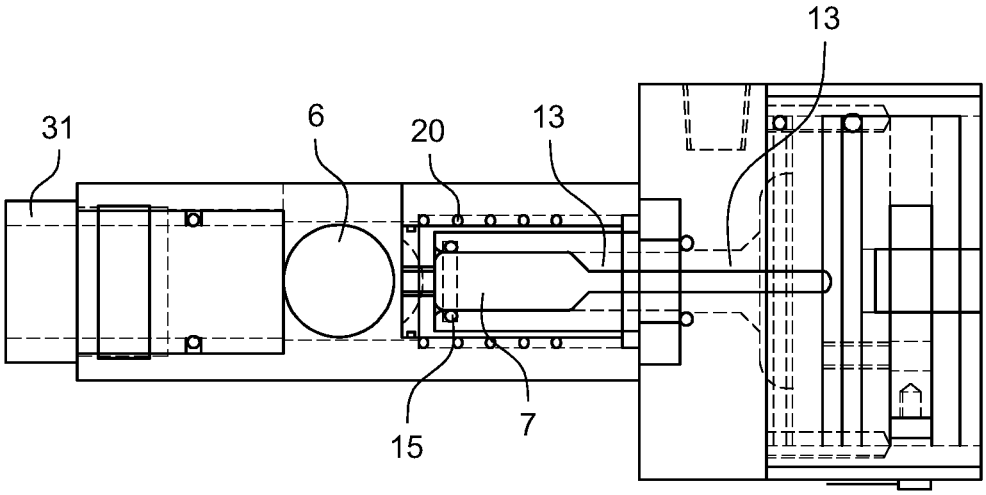

The compression piston continues to move through BDC and then back towards the bolt valve, compressing the air in the gas chamber (21) and the air passageway (13). The bolt valve is specifically a combination valve and bolt mechanism used for chambering a projectile and isolating the air which is compressed within the gas chamber (21) from the projectile (6). In the preferred embodiment the valve is formed by sealing gas passageway 13 using O-ring (15) which seals between valve stem (7) and tube (17). The air in the gas chamber (21) continues to increase in pressure until it overcomes the retention force exerted by the retention element (26). The force required to overcome the retention force is referred to as the breakaway force. In the preferred case the retention element is a rare earth magnet (26) acting on the bolt (16). Once the breakaway force is exceeded, the bolt slides along the sealing tube (17) until the valve stem (7) slides past the seal of the O-ring (15), thus exposing the projectile to the air pressure in the gas chamber. The action of the valve stem moving past the O-ring creates a snap action type valve effect, in that the opening time is extremely short. This is due to the relatively high speed of the valve stem as it is being pushed by the now unbalanced force from the compressed air and rapidly accelerates and moves past the O-ring, which opens the valve (see FIGS. 3 and 11 for example).

Several unexpected performance advantages were found by combining the bolt and the valve as described herein. For example, because the bolt accelerates forward to a high velocity, the projectile begins with a high velocity before the valve is opened. Also, because valve opening speed is critical for efficient projectile acceleration, allowing the bolt to move the chambering distance for the projectile before the O-ring (15) releases from the valve stem (7) reduces the valve opening time to less than 5 milliseconds. Moreover, because the piston is still compressing the air in the chamber as the bolt moves forward, the dead volume is minimized. (Dead volume is defined herein as the uncompressed volume into which the compressed air expands prior to pushing on the projectile.) Additionally, the bolt moving forward at high velocity allows a lighter weight bolt to be used without causing performance loss that would otherwise occur due to bolt reaction or blowback as the gas pressure acts on the bolt when the valve is released. The combination of the above unexpected advantages increased the efficiency of the electric air gun by 20% over the prior designs covered in the inventor's earlier disclosures.

Figure 9:
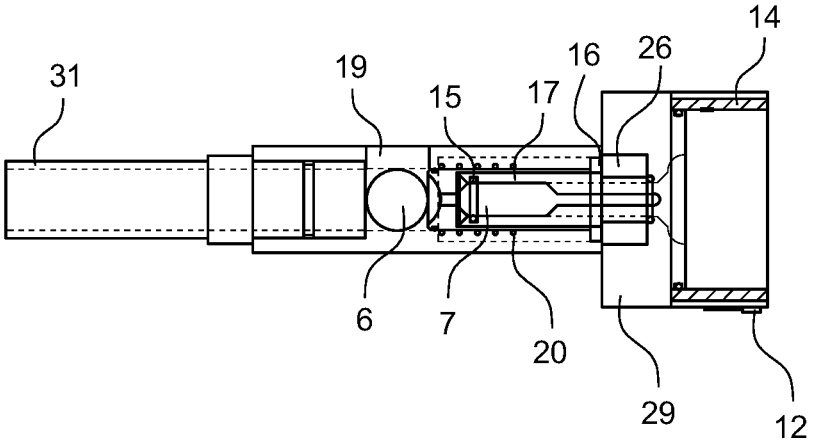
FIGS. 9-12 show exemplary operational cycle stages of a projectile launching apparatus, in accordance with an exemplary embodiment of the present disclosure.
Figure 10:
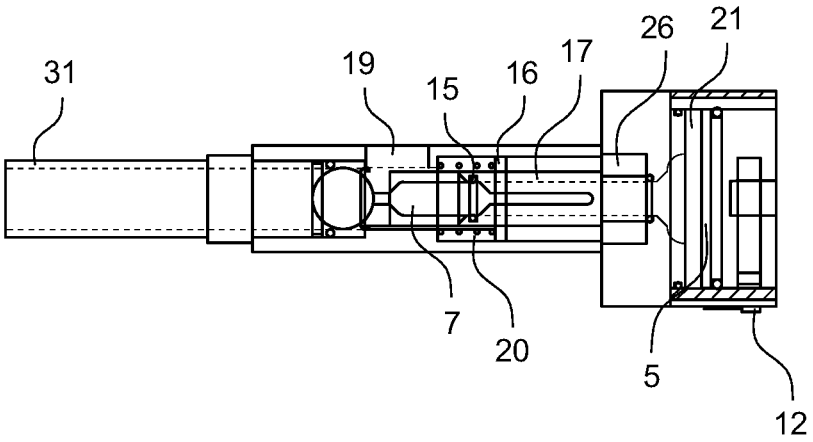

Several parameters were discovered to play importantly in the configuration of the valve (including the combination of valve stem (7) and O-ring (15) and compressed air passageway (13). They include the pressure drop through the compression valve, the speed at which the valve opens and the volume of uncompressed air between the compressed air chamber and the projectile. The bolt valve in the preferred embodiment is referred to as a snap acting valve, in that the valve has an opening speed of less than 10 milliseconds from initial cracking to greater then substantially 70% of full flow. One way to meet this requirement is that the actuation or opening force is approximately a minimum of 1.5 times the maintaining force for the valve. Additionally, it is preferred that the retention force drop off one nonlinearly with distance that the bolt moves from its retained position. An exploded view of the preferred embodiment of the bolt valve is shown in the attached FIGS. 8 through 12. In FIG. 9, the compression valve sealing member (alternately referred to herein as the O-ring (15)) is shown seating up against the valve stem (7). The bolt (16) slides over the compressed air passageway (13), which is internal to tube (17). The bolt is held in position by a retention element (26). These aspects cause the bolt valve to have a breakaway force which, when exceeded, unbalances the restraining force on the bolt and causes it to quickly chamber the ball (or other projectile, it being apparent that projectile (6) is not limited to a ball-configuration or shape for purposes of this disclosure) and open the valve, thereby communicating the compressed gas in the gas chamber and compressed air passageway (13) to the projectile, thereby forcefully driving the projectile out the barrel (31). The breakaway force in such an embodiment is controlled via the retention element (26) (which in this exemplary case is a magnet and any spacing washers (washers not shown)). The bolt assembly consisting of the bolt and valve stem, is held towards the retracted position via at least the frictional force of the sealing O-ring or the retention element, or preferably both.

The result of such a design is that a standard three gram paintball can be accelerated to a speed of 300 fps when the air in the gas chamber (21) is compressed to approximately 150 psi with a volume of approximately 1.1 $in^3$. It was discovered in earlier disclosures that if the volume of uncompressed air in the compressed air passageway (13)

exceeds 10% of the initial uncompressed volume (or 50% of the compressed air volume) formed by the gas chamber that the ball (projectile) velocity is significantly lowered. This disclosure overcomes this limitation in that the compressed air passageway is at same pressure as the gas chamber. It was further discovered that using valves that opened slower then 30 milliseconds also caused a significant loss of velocity. These were unexpected discoveries which led to the ability to practically implement single chamber housing air compressor design with a reliable and efficient projectile chambering and valving mechanism. Using other valves that do not open as quickly or as fully or rob the air stream of energy require more energy and cannot match the rate of fire or efficiency of the present disclosure.

The rapid coupling or air from the gas chamber housing to the projectile yields a very efficient transfer of the stored air energy. The compression piston continues its movement after the projectile has been launched. At this point, the cycle the power can be disconnected from the motor and the compression piston allowed to stop. The movement of the compression piston away from TDC draws a vacuum in the gas chamber which when coupled with the force from the retention element (26) and the spring (20) in the preferred embodiment resets the bolt in the first position and opens the breech such that another projectile can be loaded. This was another unexpected result in that the available time to feed the next projectile increased by 70% over the time shown in the cam driven bolt shown in U.S. Pat. No. 7,984,708.

Once the bolt nears the first position, it may be locked in place with the retention element (which may be a magnet in the preferred embodiment.) The launcher has now completed an exemplary operational cycle and is in position for another cycle. Although the preferred operation has been shown as starting with the piston starting and finishing at TDC, an equivalent operational cycle can be achieved by starting at or near BDC and finishing at or near BDC. A sensor is preferably used to determine when the compression piston is at or near either the TDC or BDC position to allow for repeatable cycle termination.

Figure 6:
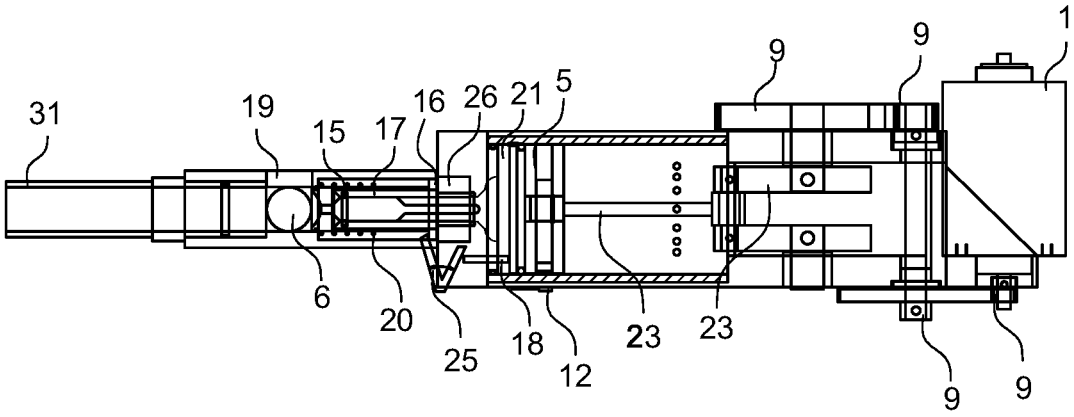
FIG. 6 is a longitudinal cross sectional view of the projectile launching apparatus of an alternative valve and bolt arrangement with the bolt held in position by a sear release, according to an exemplary embodiment of the present disclosure.
Figure 7:
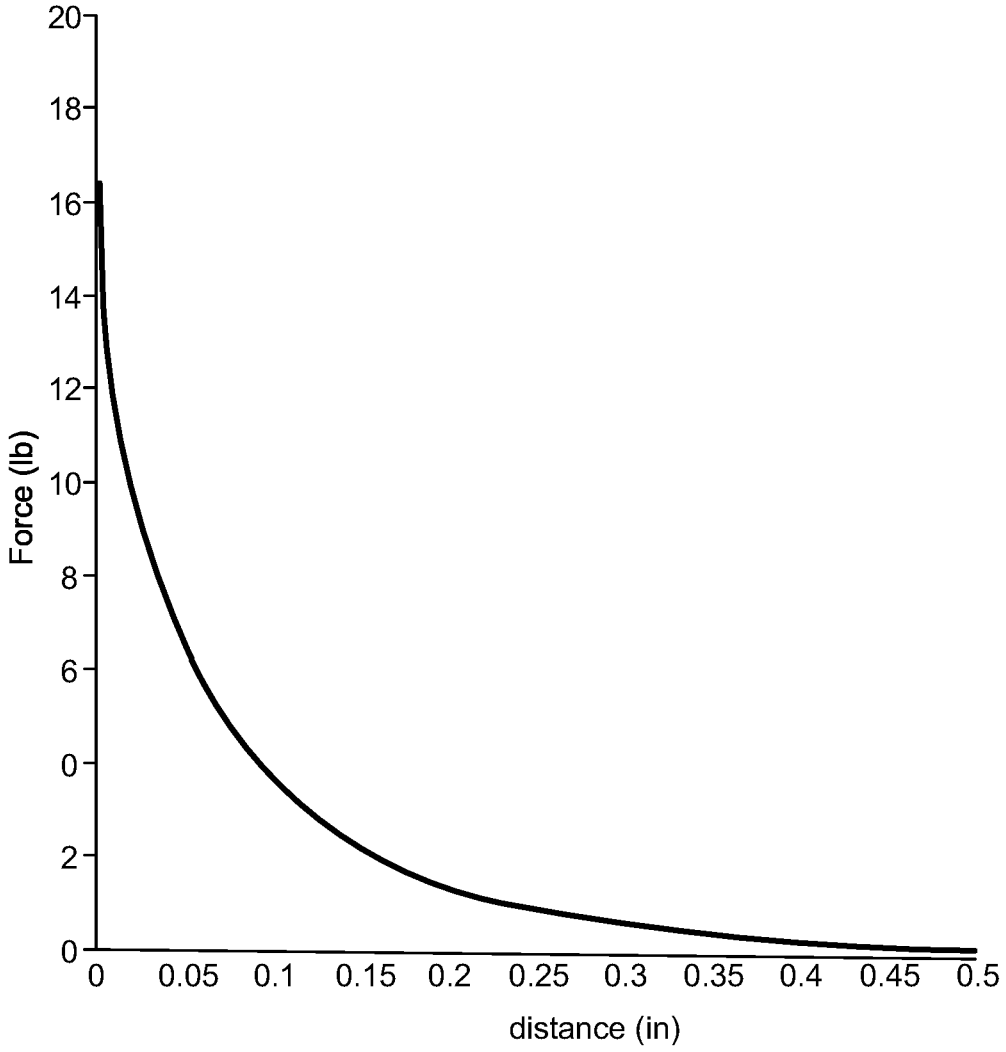
FIG. 7 is a graph of the retention force vs distance showing the nonlinearity of the magnetic bolt retention element according to an exemplary embodiment of the present disclosure.
Figure 8:
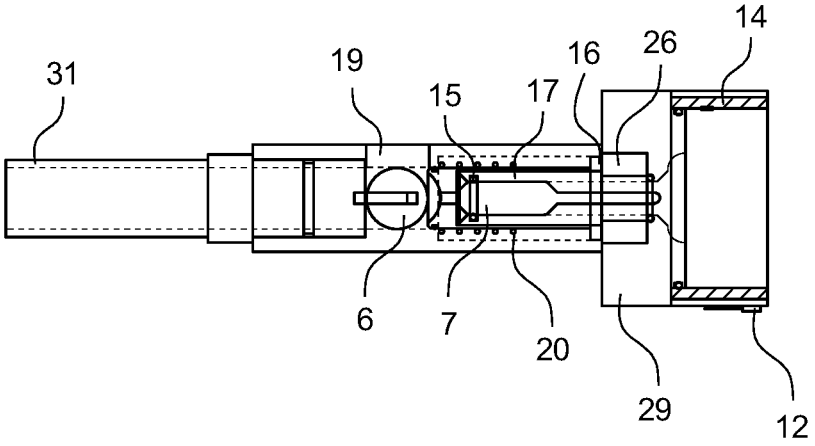
FIG. 8 is an expanded view of the magnet and bolt release system according to an exemplary embodiment of the present disclosure.

An alternative embodiment is shown in FIG. 6. In this figure, the bolt is held in position by means of a sear. The sear (25) is triggered when the compression piston has moved sufficient distance to contacts the sear release (18). The sear release disengages the sear from the bolt, thus allowing the bolt to move forward. As the bolt moves forward, it functions similarly as that described in the preferred embodiment. The bolt chambers the projectile and then the valve releases allowing the air in the gas chamber to flow to the projectile and launch it out of the barrel.

In another embodiment, it is advantageous to adjust the projectile velocity. One method for adjusting the velocity is to provide a bleed valve to the gas chamber. This adjustable valve allows for a controlled amount of gas to be bled off during the compression cycle. This reduces the amount of gas available to launch the projectile and is a very simple and cost effective method of velocity control for an electric motor driven compressed air gun using a bolt valve. An unexpected advantage of this type of velocity control is that in the event the motor stalls in the compression cycle, the bleed valve allows the compressed air to bleed out of the air chamber, thus eliminating the potential energy and reducing the likelihood of an accidental firing.

In another embodiment, the disclosure comprises a bolt valve apparatus for an electrically driven projectile launching apparatus. In an embodiment, the bolt valve apparatus comprises a gas chamber containing compressed gas; a breech assembly; an opening in the breech; a bolt reciprocally movable within the breech; an opening for a projectile in the breech; a barrel connected to said breech; a valve coupled to the bolt; a retention element, the retention element capable of retaining said bolt in a first position until a break-away force of the retention element is exceeded; and a gas passageway disposed through the bolt for pneumatically connecting the compressed gas. In an embodiment, when the force on the bolt exceeds the break-away force of the retention element, said bolt moves from said first position to a second position. and at the second position the projectile is chambered into a firing position. In an embodiment, at or near the second position, the valve is opened to communicate compressed gas through the bolt to said projectile. In an embodiment, thereafter, the bolt returns to its first position and the retention element thereafter retains said bolt in the first position until a repeat cycle is initiated.

In such an embodiment, the bolt valve apparatus may comprise a dead volume, such dead volume being between the valve and the exit of the projectile. In a further embodiment, the dead volume contained between the exit of the valve and the projectile may be less than 80% of the volume of the compressed gas in the gas chamber.

In an embodiment of the projectile launching apparatus and/or bolt valve apparatus, it is advantageous to adjust the projectile velocity. One method for adjusting the velocity is to provide a bleed valve to the gas chamber. In another embodiment, the velocity may be adjusted by a throttling needle in the gas passageway. Such a throttling needle may be disposed between the exit of the gas chamber 21 and in the gas passageway 13. By restricting the area that the gas can flow with the throttling needle (for example), the projectile velocity is decreased.

Although specific mechanical and constructive elements are described in the preferred embodiments, equivalent substitution may be done without departing from the spirit of the disclosure.

Circuit Operation:

In a preferred embodiment, the control circuit (3) includes high power switching elements and control circuit inputs. The control circuit inputs in the preferred embodiment include a sensor to indicate position in a cycle and help control the endpoint or stopping point of a cycle, a cycle start switch and a safety switch which is used to power off the device. For a lower cost apparatus at least one of these inputs may be eliminated through the use of cams and linkages. The control circuit (3) can input signals from timers and/or sensors as well as output to an interface or LED's. Looking additionally to FIG. 1, the preferred embodiment uses a start switch (10). This embodiment preferably employs at least one sensor (12) (such as a Hall sensor) and a magnet which moves cooperatively with the linear compressor and compression piston (5) assembly. Further preferred circuit embodiments include, but are not limited to: low battery indicators, pulse control of motor power, communication ports, status displays, lock out fault conditions or inputs for sequential/automatic fire.

Although the aforementioned elements are used in the preferred design, it is understood by those familiar with the art that considerable simplification is possible without departing from the spirit of the disclosure. It is further understood by those skilled in the art that the sensors can be used in conjunction with other circuit elements to allow location at different places and that sensors can be of many forms including but not limited to limit switches, hall effect sensors, photo sensors, reed switches, timers and current or voltage sensors without departing from the spirit of the disclosure.

Although there have been described particular embodiments of the present disclosure it is not intended that such references be construed as limitations upon the scope of this disclosure. The preferred embodiments of the disclosure described here are exemplary and numerous modifications, variations and rearrangements can be readily envisioned to achieve an equivalent result, all of which are intended to be embraced within the scope of the appended claims.

What is claimed is:

1. A projectile launching apparatus, the apparatus comprising:

a power source;

a control circuit electrically coupled to the power source;

a motor electrically coupled to the power source and responsive to the control circuit;

a chamber housing;

a piston reciprocally movable within the chamber housing to execute a compression stroke and a return stroke;

wherein the motor is configured to drive the compression stroke and return stroke of the piston;

a breech assembly;

a bolt reciprocally movable within the breech;

a projectile;

a valve coaxially coupled to the bolt and the valve reciprocally movable with the bolt;

a retention element the retention element capable of retaining said bolt in a first position; and a gas passageway disposed between the gas chamber and the bolt for pneumatically connecting said gas chamber and the bolt;

wherein during the compression stroke, the piston is configured to move towards an end of the chamber housing for compressing the gas in the gas chamber, the gas passageway communicating the compressed gas to the bolt, the retention element retaining the bolt in a first position until the retention element releases said bolt and upon such release, said bolt moving from said first position to a second position, and during said movement of the bolt from the first position to the second position the valve is opened thus launching said projectile.

2. The projectile launching apparatus of claim 1, wherein the retention element releases the bolt as a result of at least one of gas pressure force, a mechanical force, and an electrical force generated during the operation cycle.

3. The projectile launching apparatus of claim 1, wherein the projectile velocity is controlled by at least one of a bleed valve connected to the gas chamber and a throttling needle in the gas passageway.

4. The projectile launching apparatus of claim 1, further comprising a spring operatively coupled to the bolt for returning said bolt to a first position.

5. The projectile launching apparatus of claim 1, wherein during the compression stroke of the piston the gas in the gas chamber is compressed with a compression exponent greater than 1.1 before the bolt is released.

6. The projectile launching apparatus of claim 1, wherein the retaining force provided by the retention element decreases exponentially as the bolt moves from the first position.

7. The projectile launching apparatus of claim 1, further comprising an air replenishment mechanism, wherein said air replenishment mechanism is adapted to allow atmospheric air to flow into or out of the gas chamber.

8. The projectile launching apparatus of claim 1, wherein the retention element is one of at least one of a magnet a mechanical detent, a frictional interference or a solenoid.

9. The apparatus of claim 1, wherein the volume of uncompressed air between the chamber housing and the projectile before the valve is opened is less than 80% of the volume of the compressed gas in the gas chamber.

10. The apparatus of claim 1 wherein the valve opening time is less than 25 milliseconds.

11. The apparatus of claim 1 further comprising a sensor for controlling a stopping point of the motor in at least one position.

12. A bolt valve apparatus for a projectile launching apparatus, the bolt valve comprising:

a motor configured to be electrically driven;

a gas chamber containing gas;

a pistol reciprocally movable within the gas chamber to execute a compression stroke and a return stroke;

a breech assembly;

an opening in the breech;

a bolt reciprocally movable within the breech;

a projectile;

a valve coaxially coupled to the bolt and the valve reciprocally movable with the bolt;

a retention element the retention element capable of retaining said bolt in a first position until a break-away force of the retention element is exceeded;

a gas passageway disposed through the bolt for pneumatically connecting the compressed gas;

wherein when the force on the bolt exceeds the break-away force of the retention element, said bolt moves from said first position to a second position;

wherein at second position said projectile is chambered into a firing position;

wherein at or near said second position the valve is opened to communicate said gas through the bolt to said projectile; and wherein the bolt returns to said first position and the retention element thereafter retains said bolt in said first position until a repeat cycle is initiated.

13. The projectile launching apparatus of claim 12, wherein the break-away force is exceeded by at least one of a gas pressure force, a mechanical force, and an electrical force generated during the operation cycle.

14. The bolt valve apparatus of claim 12, wherein the projectile velocity is controlled by at least one of a bleed valve connected to the gas chamber and a throttling needle in the gas passageway.

15. The bolt valve apparatus of claim 12, wherein the retaining force provided by the retention element decreases nonlinearly or exponentially as the bolt moves from said first position.

16. The bolt valve apparatus of claim 12, wherein the retention element is at least one of a magnet, a mechanical detent, a frictional interference or a solenoid.

17. The apparatus of claim 12, wherein the volume of uncompressed air between the gas chamber and the projectile before the valve is opened is less than 80% of the volume of the compressed gas in the gas chamber.

18. The bolt valve apparatus of claim 12 wherein the valve opening time is less than 25 milliseconds.

19. The bolt valve apparatus of claim 12 further comprising said motor which acts compress the gas in the gas chamber.

* * * * *